US008926264B2

(12) United States Patent
Ring et al.

(10) Patent No.: US 8,926,264 B2
(45) Date of Patent: Jan. 6, 2015

(54) TURBO COMPRESSOR HAVING A FLOW DIVERSION CHANNEL

(75) Inventors: Hans-Joachim Ring, Gieboldehausen (DE); Joel Kofi Adomako, Moringen (DE)

(73) Assignee: Piller Industrieventilatoren GmbH, Moringen (DE)

( * ) Notice: Subject to any disclaimer, the term of this patent is extended or adjusted under 35 U.S.C. 154(b) by 0 days.

(21) Appl. No.: 13/523,507

(22) Filed: Jun. 14, 2012

(65) Prior Publication Data

US 2013/0058762 A1 Mar. 7, 2013

Related U.S. Application Data

(63) Continuation of application No. PCT/EP2010/069320, filed on Dec. 9, 2010.

(30) Foreign Application Priority Data

Dec. 16, 2009 (DE) ..... 10 2009 054 771

(51) Int. Cl.

| | |
|---|---|
| ***F04D 17/08*** | (2006.01) |
| ***F04D 29/50*** | (2006.01) |
| ***F04D 29/42*** | (2006.01) |
| ***F04D 27/02*** | (2006.01) |
| ***F04D 29/44*** | (2006.01) |

(52) U.S. Cl.

CPC ..... *F04D 29/4213* (2013.01); *F04D 27/0207* (2013.01); *F04D 27/0215* (2013.01); *F04D 29/444* (2013.01)

USPC ..... 415/56.5; 415/145

(58) Field of Classification Search

USPC ..... 415/56.4, 56.5, 57.1, 57.2, 57.4, 58.2, 415/58.4, 144, 145, 157, 167

See application file for complete search history.

(56) References Cited

U.S. PATENT DOCUMENTS 2,342,219 A * 2/1944 Price ..... 415/150
2,934,138 A * 4/1960 Warne ..... 239/126

(Continued)

FOREIGN PATENT DOCUMENTS

DE 198 23 274 C1 10/1999
DE 10 2004 003209 A1 8/2005

(Continued)

OTHER PUBLICATIONS

Machine translation of JP 2009085083 A (Apr. 23, 2009) from JPO.*

*Primary Examiner* — Justine Yu
*Assistant Examiner* — Christopher R Legendre
(74) *Attorney, Agent, or Firm* — Reinhart Boerner Van Deuren P.C.

(57) ABSTRACT

In order to improve a turbo compressor comprising a compressor housing, in which an incoming gas volume flow is supplied to an impeller channel through an inlet channel, is compressed in the impeller channel by an impeller and is discharged from the impeller channel via an outlet channel, and a flow diversion channel which is provided in the compressor housing, extends outside of the impeller channel and the inlet channel, opens into the inlet channel with an opening on the inlet side and into the impeller channel with an opening on the impeller side and conveys a diversion volume flow between the openings as a function of a difference in pressure, in such a manner that it can be operated optimally with volume flows which are far below the volume flow provided for the design point it is suggested that the flow diversion channel have a cross-sectional flow area increasing in size up to the opening on the inlet side proceeding from the opening on the impeller side.

21 Claims, 15 Drawing Sheets

(56) References Cited

U.S. PATENT DOCUMENTS

| | | | | |
|---|---|---|---|---|
| 4,743,161 | A * | 5/1988 | Fisher et al. | 415/58.4 |
| 4,930,979 | A * | 6/1990 | Fisher et al. | 415/58.4 |
| 4,990,053 | A * | 2/1991 | Rohne | 415/58.4 |
| 5,246,335 | A * | 9/1993 | Mitsubori et al. | 415/58.3 |
| 5,855,117 | A * | 1/1999 | Sumser et al. | 60/602 |
| 6,623,239 | B2 * | 9/2003 | Sahay et al. | 415/119 |
| 6,634,174 | B2 * | 10/2003 | Sumser et al. | 60/611 |
| 6,648,594 | B1 * | 11/2003 | Horner et al. | 415/145 |
| 6,699,008 | B2 * | 3/2004 | Japikse | 415/58.4 |
| 6,945,748 | B2 * | 9/2005 | Svihla et al. | 415/58.4 |
| 7,025,557 | B2 | 4/2006 | Japikse et al. | |
| 7,083,379 | B2 * | 8/2006 | Nikpour et al. | 415/56.5 |
| 7,229,243 | B2 * | 6/2007 | Nikpour et al. | 415/57.1 |
| 7,475,539 | B2 * | 1/2009 | Chen | 60/597 |
| 7,698,894 | B2 * | 4/2010 | Wood et al. | 60/605.2 |
| 7,942,625 | B2 * | 5/2011 | Sirakov et al. | 415/56.5 |
| 8,021,104 | B2 * | 9/2011 | Gu et al. | 415/56.5 |
| 8,061,974 | B2 * | 11/2011 | Gu et al. | 415/145 |
| 8,210,793 | B2 * | 7/2012 | Hale | 415/58.2 |
| 8,272,832 | B2 * | 9/2012 | Yin | 415/58.4 |
| 8,307,648 | B2 * | 11/2012 | Sumser et al. | 60/611 |
| 8,465,251 | B2 * | 6/2013 | Hosoya et al. | 415/58.2 |
| 8,517,664 | B2 * | 8/2013 | Sun et al. | 415/58.4 |
| 8,522,549 | B2 * | 9/2013 | Sumser et al. | 60/605.1 |
| 2007/0266705 | A1 * | 11/2007 | Wood et al. | 60/599 |
| 2007/0271921 | A1 | 11/2007 | Chen | |
| 2008/0247866 | A1 * | 10/2008 | Sirakov et al. | 415/144 |
| 2009/0013689 | A1 * | 1/2009 | Sumser et al. | 60/605.1 |
| 2009/0060708 | A1 * | 3/2009 | Hale | 415/58.2 |
| 2009/0214334 | A1 * | 8/2009 | Fukami | 415/206 |
| 2013/0058762 | A1 * | 3/2013 | Ring et al. | 415/144 |
| 2013/0058804 | A1 * | 3/2013 | Ring et al. | 417/369 |

FOREIGN PATENT DOCUMENTS

| | | | | |
|---|---|---|---|---|
| DE | 10 2005 019939 | A1 | | 11/2006 |
| EP | 0 913 585 | A1 | | 5/1999 |
| EP | 1 473 465 | A1 | | 11/2004 |
| EP | 1 557 568 | A2 | | 7/2005 |
| EP | 2 110 557 | A1 | | 10/2009 |
| GB | 2 077 354 | A | | 12/1981 |
| JP | 03105096 | A | * | 5/1991 |
| JP | 2006002650 | A | | 1/2006 |
| JP | 2009085083 | A | * | 4/2009 |
| KR | 2003074906 | A | * | 9/2003 |
| WO | WO 01/09517 | A1 | | 2/2001 |
| WO | WO 2007/093367 | A1 | | 8/2007 |

* cited by examiner

TURBO COMPRESSOR HAVING A FLOW DIVERSION CHANNEL

This application is a continuation of International application No. PCT/EP2010/069320 filed on Dec. 9, 2010.

This patent application claims the benefit of International application No. PCT/EP2010/069320 of Dec. 9, 2010 and German application No 10 2009 054 771.1 of Dec. 16, 2009, the teachings and disclosure of which are hereby incorporated in their entirety by reference thereto.

The invention relates to a turbo compressor comprising a compressor housing, in which an incoming gas volume flow is supplied to an impeller channel through an inlet channel, is compressed in the impeller channel by an impeller and discharged from the impeller channel via an outlet channel, and a flow diversion channel which is provided in the compressor housing, extends outside of the impeller channel and the inlet channel, opens into the inlet channel with an opening on the inlet side and into the impeller channel with an opening on the impeller side and conveys a diversion volume flow between the openings as a function of a difference in pressure.

Such a turbo compressor is known, for example, from EP 0 913 585131.

Such a turbo compressor is not designed with a view to as optimum an operation as possible with volume flows which are far below the volume flow provided for the design point.

The object underlying the invention is, therefore, to improve a turbo compressor of the generic type in such a manner that it can be operated optimally with volume flows which are far below the volume flow provided for the design point.

This object is accomplished in accordance with the invention, in a turbo compressor of the type described at the outset, in that the flow diversion channel has a cross-sectional flow area which increases in size up to the opening on the inlet side proceeding from the opening on the impeller side.

The advantage of the solution according to the invention is to be seen in the fact that with such a cross-sectional flow area which increases in size from the opening on the impeller side up to the opening on the inlet side, a diversion volume flow flowing in this direction will be retarded on account of the possible expansion and then enters the gas volume flow flowing through the inlet channel via the opening on the inlet side without causing any great turbulence.

It is particularly favorable when the cross-sectional flow area of the flow diversion channel increases constantly in size with increasing extension thereof from the opening on the impeller side towards the opening on the inlet side in order to obtain a favorable formation of a diversion volume flow from the opening on the impeller side to the opening on the inlet side for stabilizing the flow during partial load operation.

One particularly advantageous solution of a turbo compressor according to the invention provides for a cross-sectional flow area of the opening on the inlet side to be in the range of between 2.5 times and 3 times the cross-sectional flow area of the opening on the impeller side.

With such a dimensioning of the cross-sectional flow area, the desired delay of the diversion volume flow for stabilizing the partial load operation can be achieved.

It is even better when the cross-sectional flow area of the opening on the inlet side is in the range of between 2.3 times and 2.7 times the cross-sectional flow area on the impeller side.

Alternatively or in addition to the solution described above, the object specified at the outset is also accomplished in accordance with the invention, in a turbo compressor of the type described at the outset, in that the flow diversion channel is formed by channel segments which are arranged next to one another in a circumferential direction with respect to an impeller axis, i.e. the flow diversion channel does not extend continuously around the impeller channel in a circumferential direction but is rather subdivided into such individual channel segments.

In this respect, it is particularly advantageous when the channel segments are separated from one another in the circumferential direction so that, as a result, any swirling resulting in the region of the impeller will not be transferred through the flow diversion channel but will be retarded in the flow diversion channel so that a swirl-free diversion volume flow exits, in particular, from the opening of the flow diversion channel on the inlet side.

One particularly simple solution for the separation of the channel segments in circumferential direction is given when the channel segments are separated from one another by ribs which extend in radial planes relative to the impeller axis.

No further details have likewise been given in conjunction with the preceding explanations concerning the individual embodiments with respect to the arrangement of the opening of the flow diversion channel on the impeller side.

One particularly advantageous solution provides, for example, for the opening of the flow diversion channel on the impeller side to be located in a region of the impeller channel, in which the impeller blades move.

It is particularly favorable when the opening of the flow diversion channel on the impeller side is located in the region between ends of long impeller blades on the inlet side and ends of short impeller blades on the inlet side.

With respect to the arrangement of the opening on the impeller side, it is particularly advantageous when the opening of the flow diversion channel on the impeller side is located in a surface which extends constantly in relation to a flow guiding surface located upstream of this opening and a flow guiding surface located downstream of this opening.

Furthermore, it is of advantage when the opening of the flow diversion channel on the impeller side is designed to extend around the impeller axis in a circumferential direction, i.e. the opening of the flow diversion channel on the impeller side extends around the entire impeller channel and, therefore, allows the diversion volume flow to flow away over the entire extent of the gas volume flow in the impeller channel.

Where applicable, the opening of the flow diversion channel is interrupted by ribs or webs which subdivide the flow diversion channel into individual segments which follow one another in a circumferential direction.

With respect to the arrangement of the opening of the flow diversion channel on the inlet side, no further details have so far been given.

One advantageous solution, for example, provides for the opening of the flow diversion channel on the inlet side to be located upstream of the impeller.

In this respect, it is particularly favorable when the opening of the flow diversion channel on the inlet side is arranged at a distance from the impeller blades which corresponds at least to an extension of the impeller blades in the direction of the impeller axis.

In addition, it is favorable within the scope of the solution according to the invention when the opening of the flow diversion channel on the inlet side is located in a surface which extends essentially parallel to a direction of flow of the gas volume flow in the inlet channel.

This means that the opening of the flow diversion channel on the inlet side is arranged such that it does not interfere with the gas volume flow in the inlet channel but rather, on account of its essentially parallel alignment in relation to the direction of flow of the gas volume flow, has no or an insignificant influence on it.

In this respect, it is particularly favorable when the opening of the flow diversion channel on the inlet side is located in a surface which extends constantly in relation to flow guiding surfaces in the inlet channel upstream of the opening and flow guiding surfaces downstream of the opening. As a result, it is ensured that the flow guiding surfaces guide the gas volume flow past the opening on the inlet side such that it essentially does not experience any interference.

In the simplest case, it is provided for the opening of the flow diversion channel on the inlet channel side to be located in a surface which is cylindrical to the impeller axis.

One particularly favorable solution provides, in addition, for the opening of the flow diversion channel on the inlet channel side to be designed to extend circumferentially in relation to an impeller axis, i.e. extend completely around the inlet channel and therefore be in a position to supply a diversion volume flow to the gas volume flow or discharge it therefrom at all the outer sides of the outlet channel.

With respect to the design of the flow diversion channel for introducing the diversion volume flow into the inlet channel, no further details have so far been given.

One advantageous solution provides, for example, for the flow diversion channel to deflect a diversion volume flow coming from the opening on the impeller side in the region of the opening on the inlet side to such an extent that it exits into the inlet channel with a direction of flow transverse to the direction of flow of the incoming gas volume flow. As a result, it is ensured that the diversion volume flow will be supplied to the gas volume flow entering the inlet channel with as little interference as possible.

In this respect, it is particularly favorable when the flow diversion channel has flow deflecting surfaces which deflect the diversion volume flow exiting from the flow diversion channel in a direction transverse to the gas volume flow entering the inlet channel.

Alternatively or in addition to the features of a turbo compressor according to the invention, which have been described thus far, an additional solution according to the invention provides for the flow diversion channel of the turbo compressor to be configured such that it facilitates a diversion volume flow from the opening on the impeller side to the opening on the inlet side in the partial load range.

In this respect, it is particularly advantageous when the flow diversion channel is designed such that it is in a position during partial load operation to convey more than 20% of the gas volume flow flowing to the impeller.

This solution likewise has the advantage that, with it, it is possible to operate the operation of the turbo compressor in partial load operation with gas volume flows which are significantly reduced in comparison with the design point.

Furthermore, one solution according to the invention of the object specified at the outset provides, alternatively or in addition to the solutions described thus far, for the flow diversion channel to allow a partial load operation of the turbo compressor with gas volume flows which are between 40% of the gas volume flow provided in the design point and the gas volume flow in the design point.

In conjunction with the preceding explanations of the individual embodiments, it has always been assumed that in the flow diversion channel the diversion volume flow and, in particular, the direction of the diversion volume flow is set in accordance with a difference in pressure between the opening on the impeller side and the opening on the inlet side and that this difference in pressure is exclusively responsible for the direction and the strength of the diversion volume flow.

The object according to the invention can, however, be advantageously accomplished in a further embodiment in that the flow diversion channel can be closed by a closure unit.

Such a closure unit provides the possibility of influencing not only the occurrence of a diversion volume flow but also its strength and indirectly also its direction.

As a result, it is possible in a simple manner to also be able, when designing the turbo compressor, to avoid operational states, with which—even though a diversion volume flow can occur in one or the other direction on account of the difference in pressure—such a diversion volume flow is suppressed entirely or partially.

It is, in particular, possible, as a result, to interrupt a diversion volume flow from the opening on the inlet side to the opening on the impeller side, which can occur, in particular, in the case of overload states above the design point or, however, also at the design point or close to the design point, depending on how the pressure ratios in the turbo compressor are determined in detail.

As a result, it is possible, even in the partial load range directly below the design point with a dimensioning of the turbo compressor which would lead to a diversion volume flow from the opening on the inlet side to the opening on the impeller side, for this diversion volume flow to, however, be suppressed by the closure unit.

The closure unit can be designed in the most varied of ways.

One solution provides for the closure unit to have a spring-loaded valve element and so the closure unit acts independently and, therefore, acts, for example, in such a manner that it always allows a diversion volume flow from the opening on the impeller side to the opening on the inlet side but prohibits any diversion volume flow from the opening on the inlet side to the opening on the impeller side, irrespective of the difference in pressure between the opening on the inlet side and the opening on the impeller side.

As a result, it is possible to design the turbo compressor such that a difference in pressure, which would lead to a deflection volume flow from the opening on the inlet side to the opening on the impeller side, results between the opening on the inlet side and the opening on the impeller side even, for example, at the design point or also in the partial load range below the design point but this volume flow will be prohibited automatically by the spring-loaded valve element.

For example, the spring-loaded valve element is designed as a so-called flutter valve, i.e. formed by small, thin metal plates which can be bent for the purpose of opening but during closing remain in their non-bent state and, for example, rest on surfaces provided accordingly.

A further, advantageous solution provides for the closure unit to have a controllable closure element.

Such a controllable closure element is, therefore, not designed such that it closes automatically when a diversion volume flow, which is intended to be suppressed, occurs but is designed such that it is activated.

Such a controllable closure element can be designed in the most varied of ways and be provided in the turbo compressor, for example, either in the flow diversion channel itself or one of the openings of the flow diversion channel.

In order to be able to activate such a controllable closure element in a suitable manner, it is either possible to provide a manual activation or it is possible to control this closure element by means of an adjusting drive and a control, wherein the control can not only provide for this closure element to be either opened or closed but can also advantageously provide for the closure element to control, in addition, the strength of the diversion volume flow when this is actually permitted.

For example, it is possible to ascertain the pressure ratios in the turbo compressor by means of pressure measurements, in the simplest case at the opening on the inlet side and the opening on the impeller side, and where applicable to use additional pressure measurements to also be able to detect the flow ratios in the turbo compressor as accurately as possible.

As a function of the pressure and flow ratios, activation of the controllable closure element can then be brought about in such a manner that it allows a diversion volume flow when this improves or benefits the mode of operation of the turbo compressor but suppresses a diversion volume flow in all other cases.

In addition, it is also possible to control the strength of this diversion volume flow depending on the necessity of the pressure and flow ratios in the turbo compressor.

In particular, flow instabilities in the turbo compressor may also be detected by way of suitable pressure measurements and it is also possible to detect the occurrence of flow instabilities by means of such pressure measurements and then control the diversion volume flow accordingly.

Alternatively or in addition to pressure measurements in the turbo compressor, it is also possible to detect the rotational speed of the impeller in addition and this is a further parameter for the extent, to which a diversion volume flow is necessary or not for stabilizing the flow in the turbo compressor, in particular in the partial load range.

In the case of all the solutions with a closure unit, it is, therefore, possible to determine more or less precisely, with what operational states a diversion volume flow through the flow diversion channel should be allowed or not in order to stabilize the flow ratios in the turbo compressor and, in particular, to prevent any "pumping".

Additional features and advantages of the invention are the subject matter of the following description as well as the drawings illustrating one embodiment.

Figure 1:
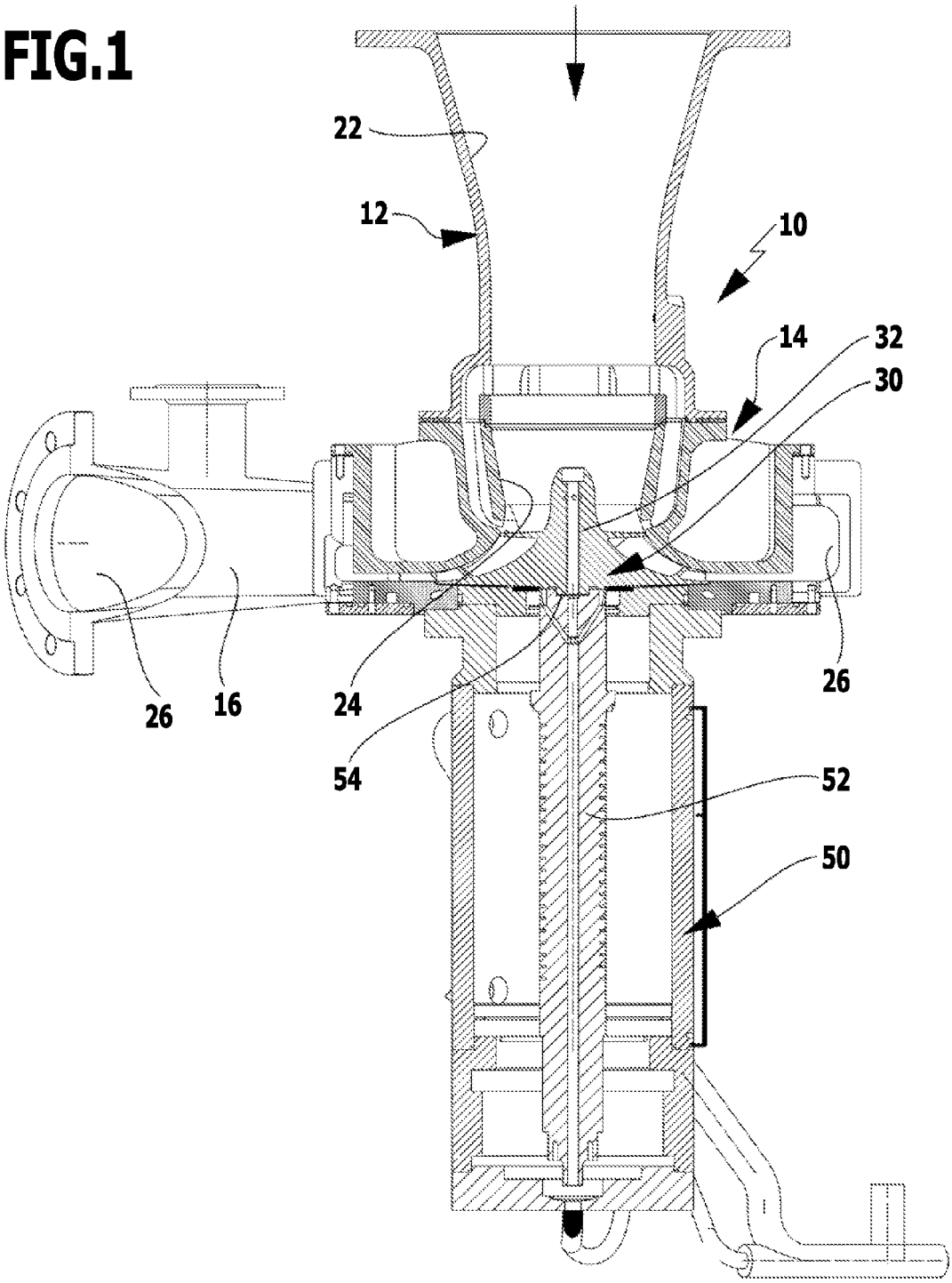
FIG. 1 shows a longitudinal section through a first embodiment of a turbo compressor according to the invention.

One embodiment of a turbo compressor according to the invention, illustrated in FIG. 1, comprises a compressor housing which is designated as a whole as 10 and comprises an inlet housing 12, an impeller housing 14 and an outlet housing 16.

The inlet housing 10 forms at least in part an inlet channel 22 which merges in the impeller housing 14 into an impeller channel 24 and this, on the other hand, merges into an outlet channel 26 in the outlet housing 16.

Figure 2:
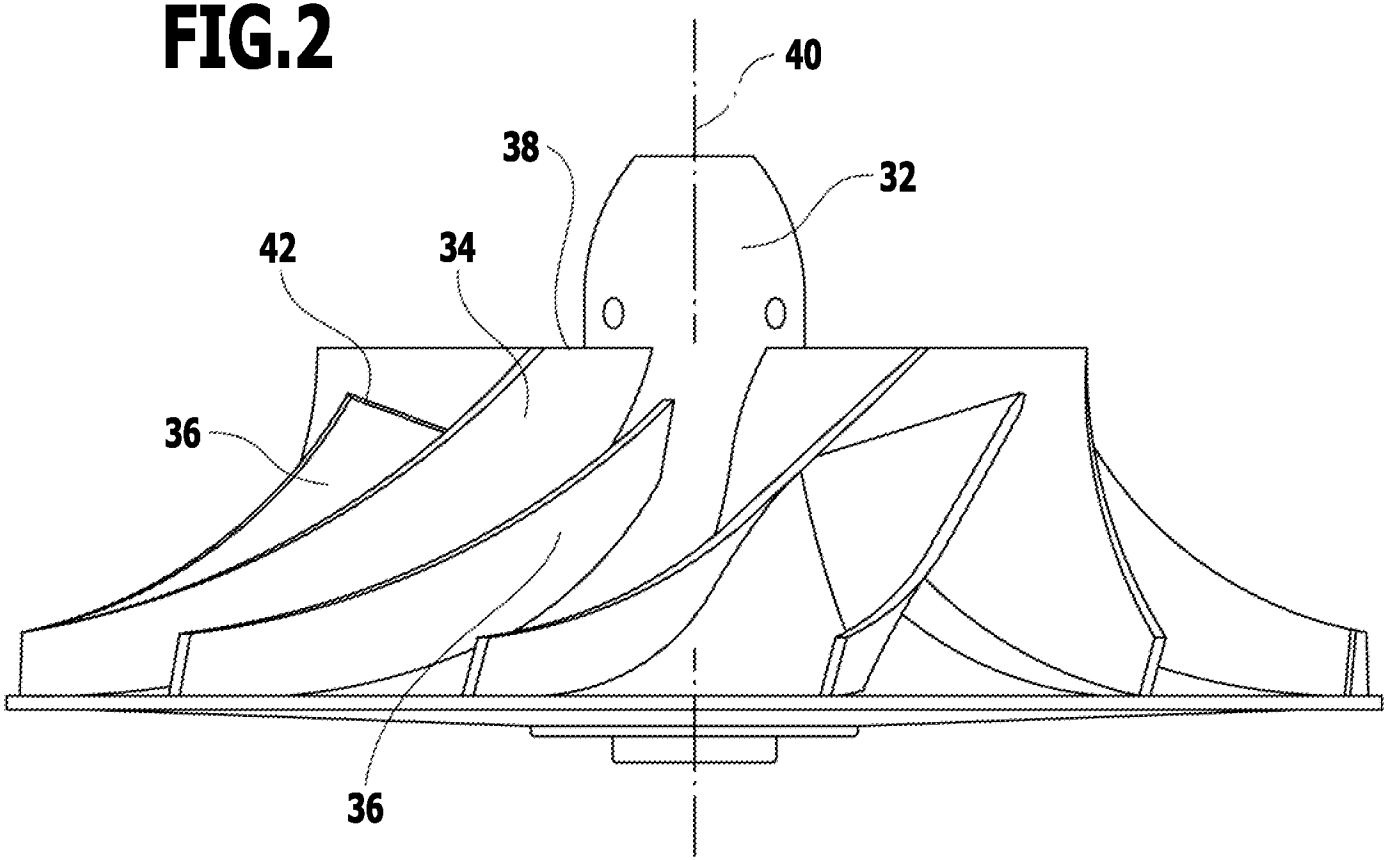
FIG. 2 shows a side view of an impeller of the turbo compressor according to the invention.

An impeller designated as a whole as 30 is provided in the impeller channel 24 and, as illustrated in FIG. 2, comprises a hub body 32, on which impeller blades 34 and 36 are arranged, wherein the impeller blades 34 are so-called long impeller blades, the ends 38 of which on the inlet channel side extend in a direction parallel to an impeller axis 40 further upstream in the direction of the inlet channel 22 than ends 42 on the inlet side of the so-called short impeller blades 36.

The impeller 30 is driven by a drive motor 50, on the motor shaft 52 of which the impeller 30 is seated with its hub body 32, wherein the hub body 32 is connected to the motor shaft 52 on an underside 54 facing away from the impeller blades 34, 36 and is borne and guided by the motor shaft 52.

The drive motor 50 is a typical, high-speed drive motor for a turbo compressor which has, for example, magnetic bearings for the motor shaft 52.

Figure 3:
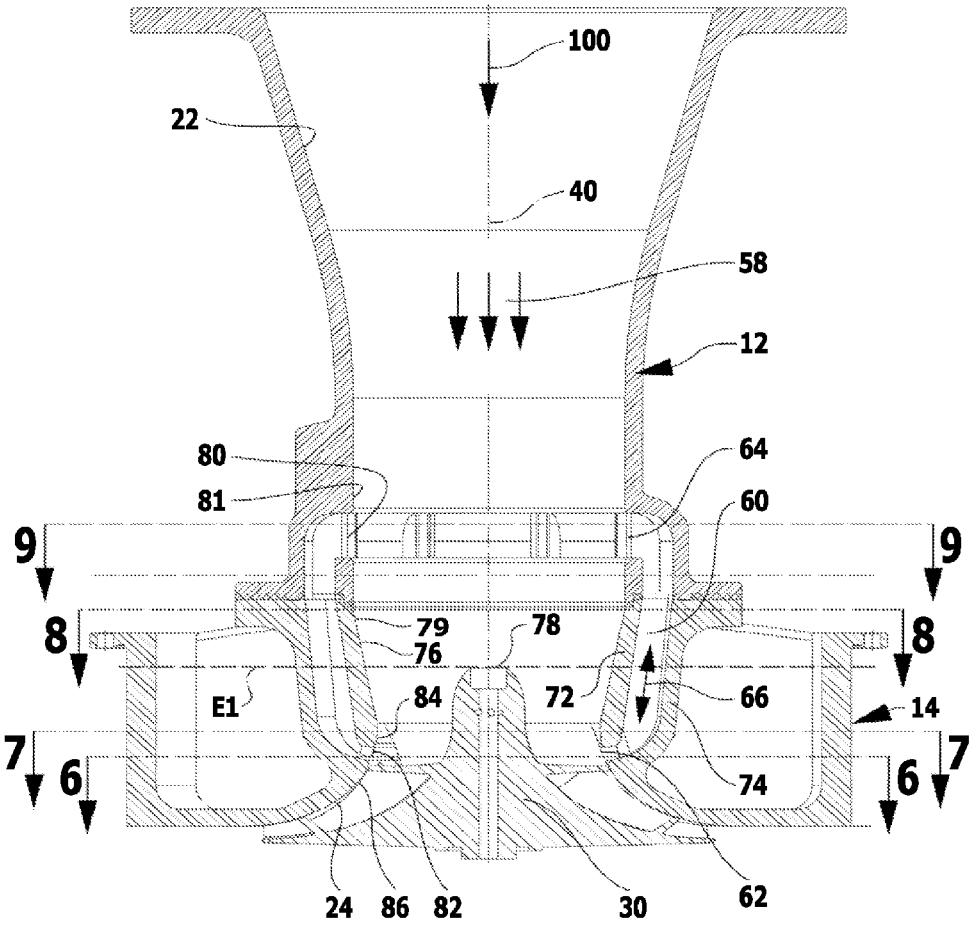
FIG. 3 shows an enlarged longitudinal section according to FIG. 1 in the region of an inlet housing and an impeller housing.
Figure 4:
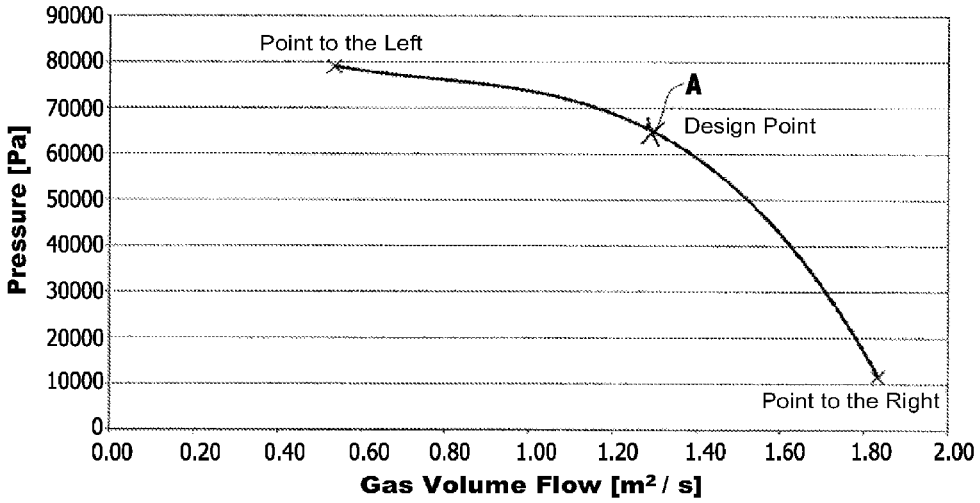
FIG. 4 shows a schematic illustration of a compressor characteristic curve for a turbo compressor according to the invention.

As illustrated in FIG. 3 on an enlarged scale, the inlet channel 22 conveys a gas volume flow 58 which propagates with increasing speed towards the impeller 30 on account of the narrowing cross-sectional surface area of the inlet channel and as a result of its impeller blades 34 and 36 the gas volume flow 58 is increasingly compressed in the impeller channel 24, wherein the turbo compressor operates according to the characteristic curve of the compressor which is illustrated in FIG. 4 and represents the increase in pressure over the gas volume flow.

The design of the turbo compressor, i.e., in particular, of the impeller 30 and the inlet channel 22, the impeller channel 24 and the outlet channel 26, is brought about with respect to a design point A of the characteristic curve of the compressor illustrated in FIG. 4, wherein the design point A is located at a defined gas volume flow 58 and a corresponding increase in pressure is associated with the design point A as a result of the characteristic curve of the compressor.

The turbo compressor according to the invention is, however, intended to be operated not only in the region of the design point A but can also be operated with smaller gas volume flows 58, with which, as results from the characteristic curve of the compressor, the increase in pressure is greater than in the design point A and the gas volume flow 58 is, however, likewise appreciably smaller.

It is, however, also possible in accordance with the characteristic curve of the compressor to operate the turbo compressor with gas volume flows which are greater than those in the design point, wherein, in this case, the increase in pressure of the turbo compressor is, however, increasingly reduced.

If the turbo compressor is operated with gas volume flows which are smaller than the gas volume flow in the design point A, there is the problem that the turbo compressor starts to "pump" on account of flow instabilities, wherein this "pumping" is brought about by flow instabilities in the region of the impeller 30 within the impeller channel 24 and this leads to a partial flow back of the gas volume flow from the impeller channel 24 into the inlet channel 22.

For this reason, a flow diversion channel 60 is provided and this extends not only in the impeller housing 14 but also in the inlet housing 12, is arranged so as to extend around a section of the inlet channel 22 and around a section of the impeller channel 24, each time extending radially around them on the outside, and, as illustrated in FIG. 3, extends from an opening 62 on the impeller side to an opening 64 on the inlet side, wherein a diversion volume flow 66 is formed in the flow diversion channel 60, the direction and size of this diversion volume flow being dependent on the difference in pressure between the opening 62 on the impeller side and the opening 64 on the inlet side.

If, for example, as illustrated in FIG. 4, the turbo compressor is operated with a gas volume flow 58 which is smaller than the gas volume flow 58 in the design point A, i.e. in partial load operation, a higher pressure occurs at the opening 62 of the flow diversion channel 60 on the impeller side than is present at the opening 64 on the inlet side and, therefore, a diversion volume flow 66*a* is formed through the flow diversion channel 60 in such a manner that the diversion volume flow 66*a* flows from the opening 62 on the impeller side to the opening 64 on the inlet side and passes through it in order to enter the inlet channel 22.

The flow diversion channel 60 is limited by a wall 72 of the impeller housing 14 and the inlet housing 12 which is located radially inwards with regard to the impeller axis 40 as well as a wall 74 of the impeller housing 14 and the inlet housing 12 which is located radially outwards, wherein the wall 72 which is located radially inwards forms at the same time an end section 76 of the inlet channel 22 which merges into the impeller channel 24.

The end section 76 is preferably located between the opening 64 of the flow diversion channel 60 on the inlet side and the hub body 32 of the impeller 30.

The end section 76 of the inlet channel 22 merges into the impeller channel 24 in the region of a plane E1 which extends at right angles to the impeller axis 40 and touches the hub body 32 at its upper area 78 on the inlet side.

Furthermore, the end section 76 is preferably located between the opening 64 of the flow diversion channel 60 on the inlet side and the plane E1 and has a flow guiding surface 79 which merges constantly into a surface 80, in which the opening 64 on the inlet side is located.

Moreover, the inlet channel 22 comprises a flow guiding surface 82 which leads as far as the opening 64 of the flow diversion channel 60 on the inlet side.

The opening 62 of the flow diversion channel 60 on the impeller side, which is arranged in the wall 72 located radially inwards, is located in a surface 82 which merges constantly into a flow guiding surface 84 of the impeller channel 24 which borders upstream on the opening 62 on the impeller side and a flow guiding surface 86 of the impeller channel 24 which borders on the opening downstream.

Figure 5:
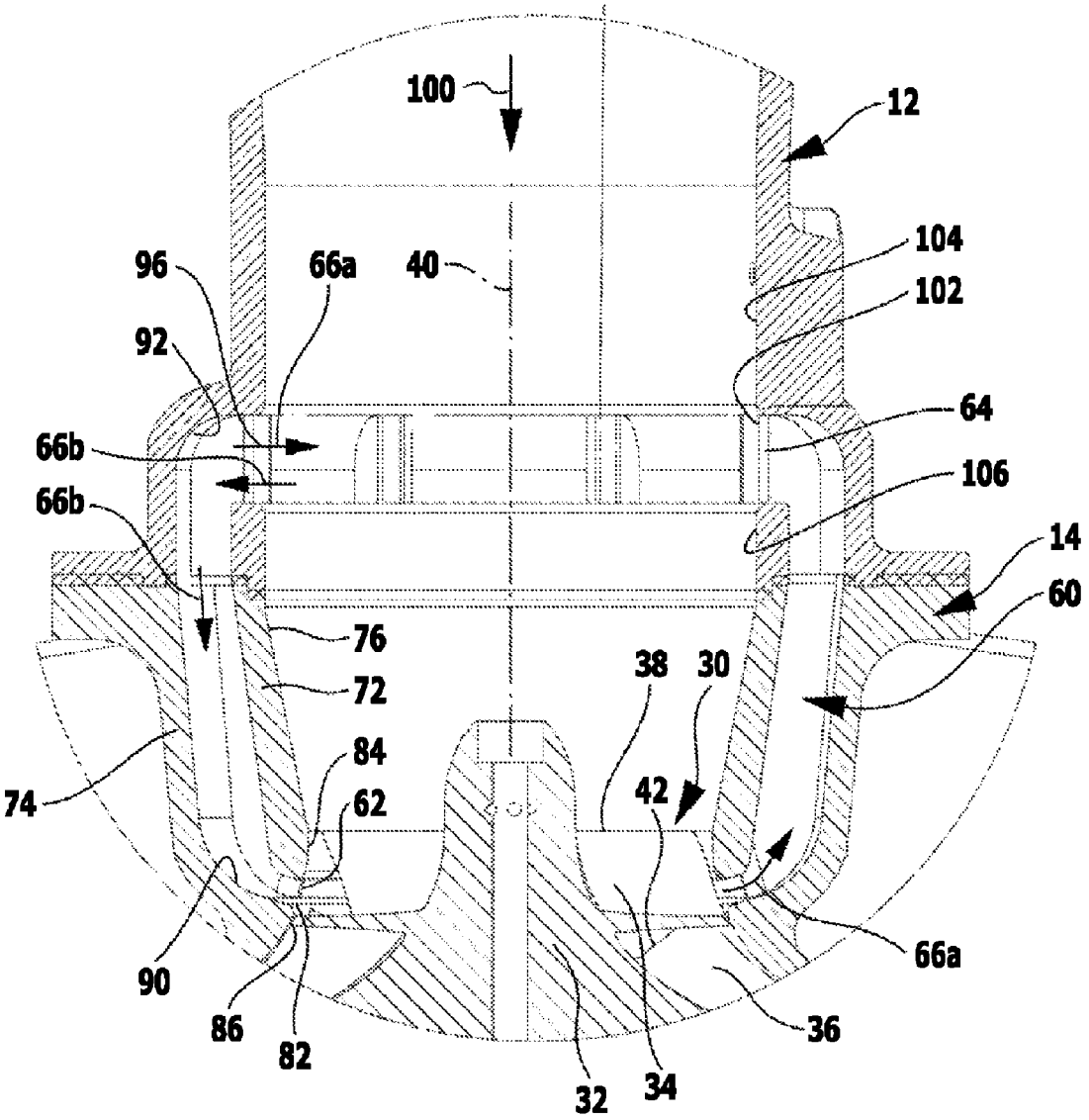
FIG. 5 shows an even more enlarged illustration of part of the impeller housing and the inlet housing in particular in the region of a flow diversion channel.

In addition, the opening 62 on the impeller side is arranged such that it is located in the direction of the impeller axis 40 between the end 38 of the long impeller blades 34 on the inlet side and the end 42 of the shorter impeller blades 36 on the inlet side (FIG. 5).

The reason for this is that during operation of the turbo compressor with a gas volume flow 58 which is below the design point A, vortices are formed immediately downstream of the ends 38 of the impeller blades 34 on the inlet side and these contribute to the "pumping" on account of flow instabilities. These vortices should preferably be eliminated and for this reason the opening 62 on the impeller side is provided in the area specified in the above in order to create the possibility, with a gas volume flow which is smaller than the gas volume flow in the design point A, of not allowing the vortices which are formed to flow through the impeller channel 24 but rather to allow them to exit out of the impeller channel 24 to the side radially to the rotor axis 40.

Figure 6:
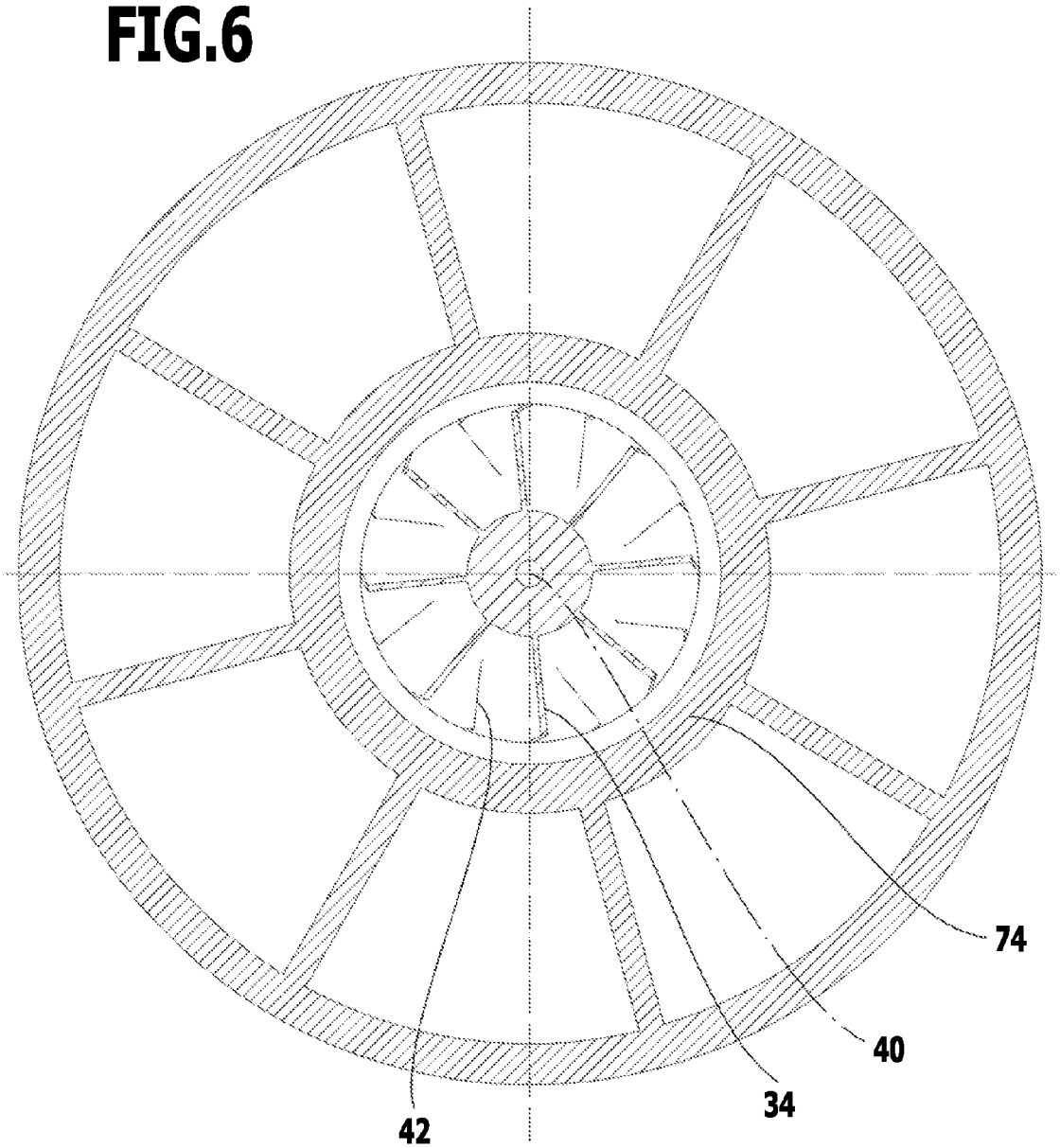
FIG. 6 shows a section along line 6-6 in FIG. 3.
Figure 7:
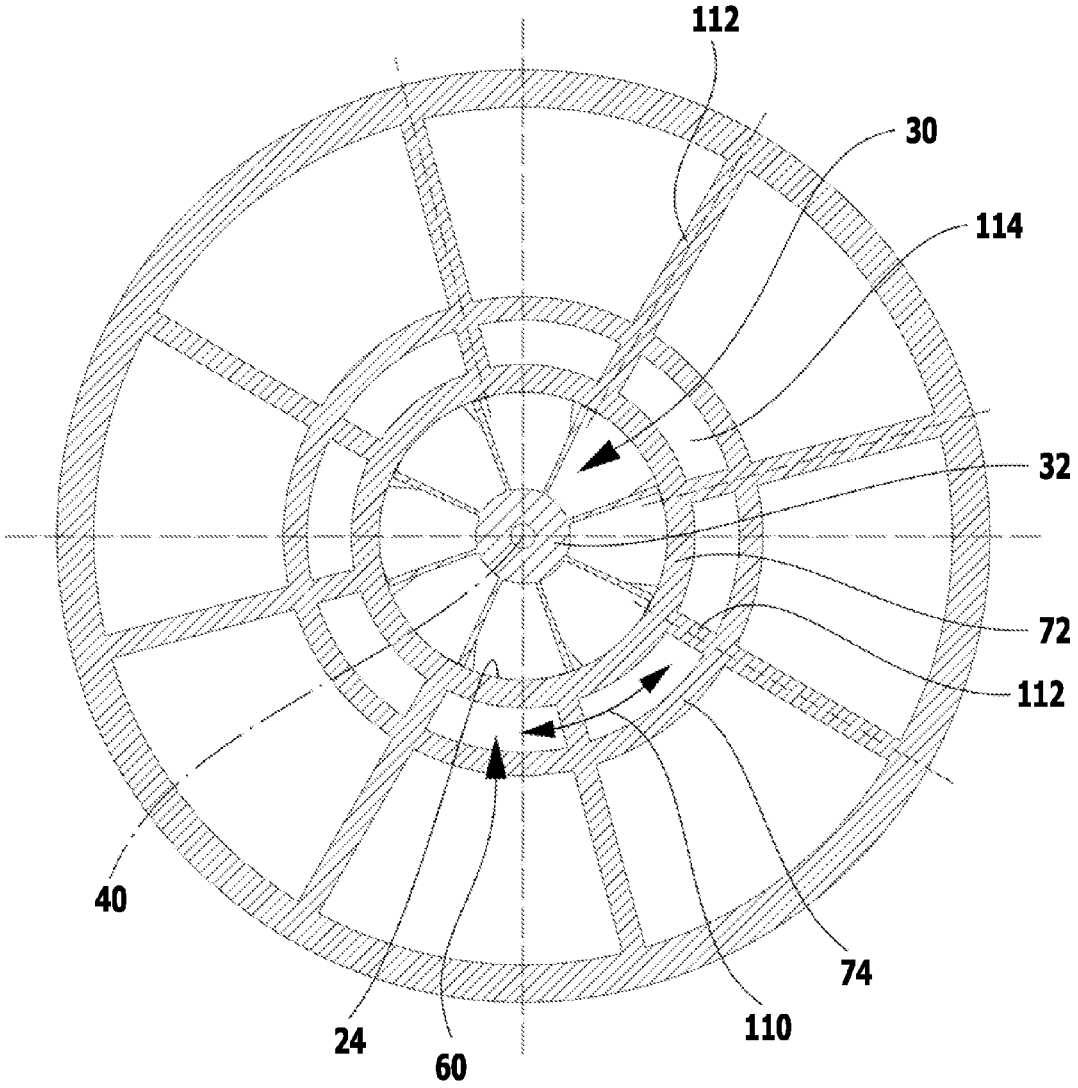
FIG. 7 shows a section along line 7-7 in FIG. 3.
Figure 8:
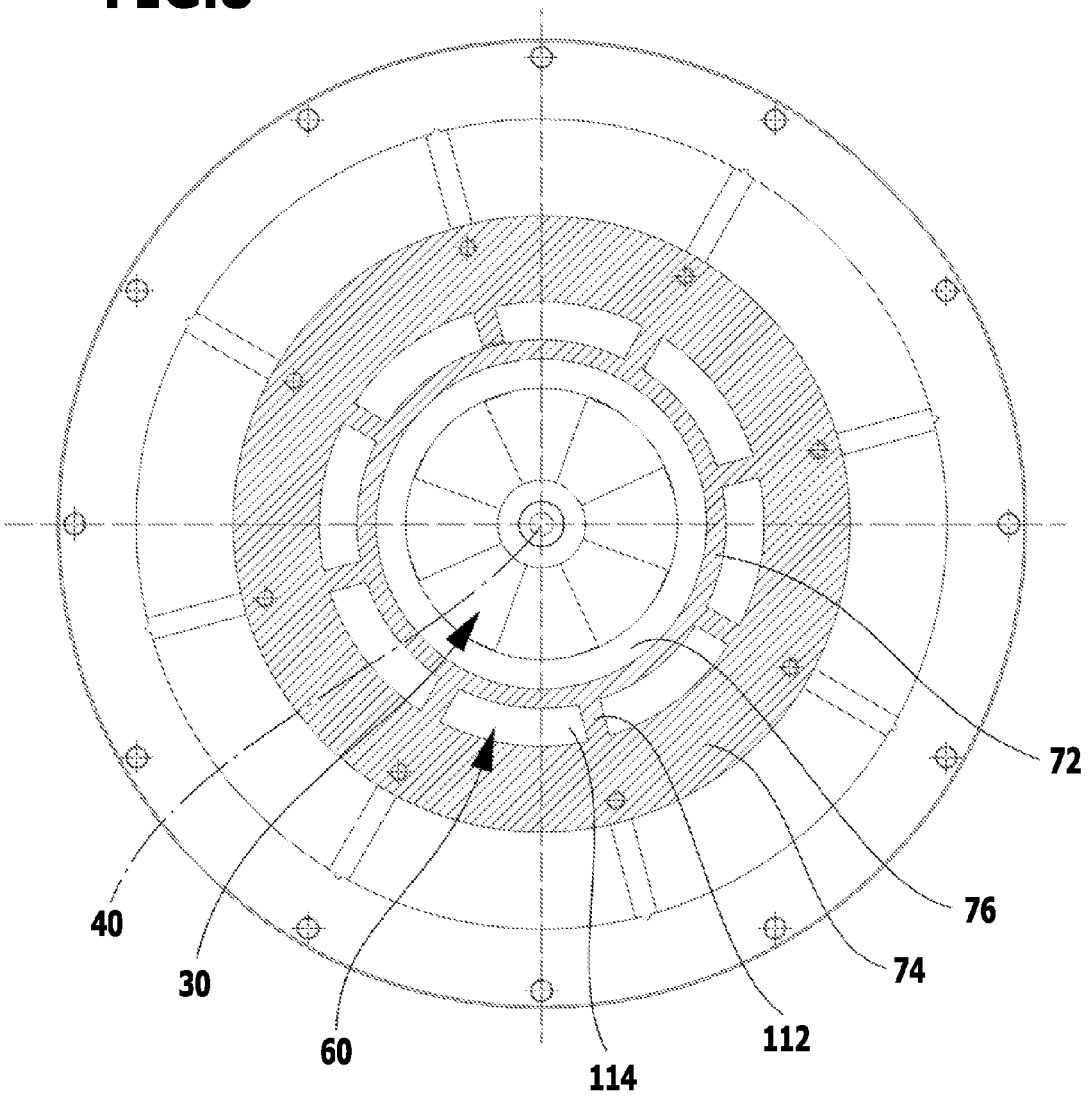
FIG. 8 shows a section along line 8-8 in FIG. 3.
Figure 9:
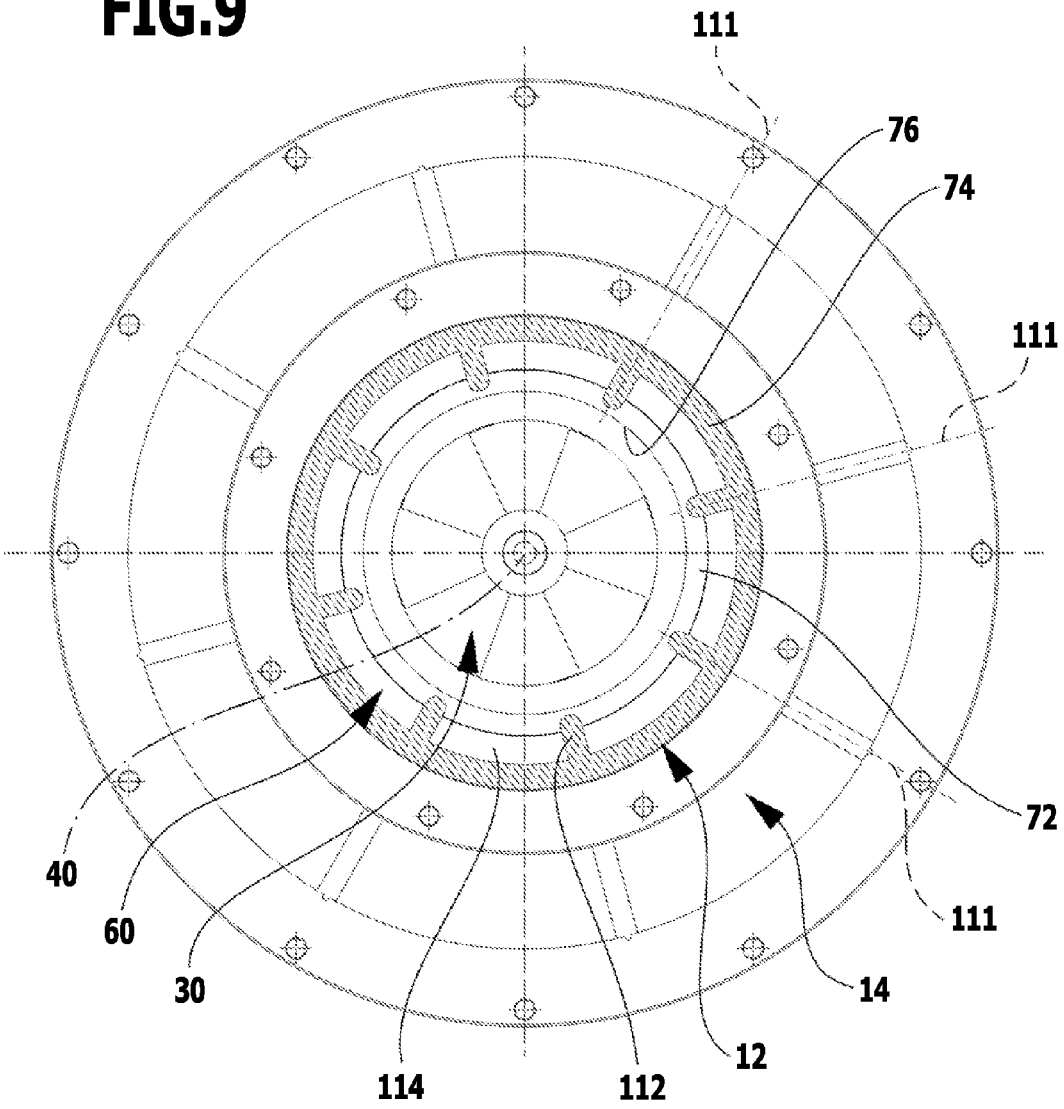
FIG. 9 shows a section along line 9-9 in FIG. 3.

As illustrated in FIGS. 5 and 6, a diversion volume flow 66 exiting through the opening 62 on the impeller side impinges on a deflecting surface 90 which is formed by the wall 74 located radially outwards and deflects the diversion volume flow 66*a* in the direction of the opening 64 on the inlet side so that it flows between the wall 72 located radially inwards and the wall 74 located radially outwards in the direction of the opening 64 on the inlet side and prior to reaching the opening 64 on the inlet side is deflected by a deflecting surface 92, likewise formed by the wall 74 located radially outwards, such that the exiting deflection volume flow 66*a* has a direction of flow 96 which extends transversely to a direction of flow 100, with which the incoming gas volume flow 58 flows in the inlet channel 22 in the direction of the impeller 30.

Such a diversion volume flow 66*a* occurs when the pressure at the opening 62 on the impeller side is greater than at the opening 64 on the inlet side and so a part of the gas volume flow 58 entering the inlet channel 22 on account of the difference in pressure enters the opening 62 on the impeller side as diversion volume flow 66*a* and flows into the opening 64 on the inlet side via the flow diversion channel 60.

The opening 64 on the inlet side is arranged, in particular, such that it is located in a geometric surface 102 which constantly borders on a surface 104 located upstream as well as a surface 106 located downstream and, therefore, does not cause any gas volume flow 58 entering the inlet channel 22. The surfaces 102, 104 and 106 are, for example, cylindrical surfaces which extend coaxially to the impeller axis 40.

A flow state in the turbo compressor, with which an operational state responsible for the formation of the diversion volume flow 66*a* occurs, is normally present when the gas volume flow 58 is smaller than the gas volume flow 58 provided for the design point A and so pressure is already built up on the inlet side of the impeller 30 by means of the impeller blades 34 and this is responsible for the formation of the diversion volume flow 66*a*.

The formation of the diversion volume flow 66*a*, in particular in the case of operational states with smaller gas volume flows 58 than provided for the design point, is facilitated by the arrangement of the openings 64 of the flow diversion channel 60 on the inlet side since the gas volume flow 58 entering via the inlet channel 22 does not give rise to any damming effect and, therefore, any increase in pressure whatsoever in the opening 64 on the inlet side as a result of the arrangement of the opening 64 on the inlet side in the cylindrical surface 80 which is coaxial to the impeller axis 40 and so no effects counteracting the diversion volume flow 66 occur in the region of the opening 64 on the inlet side.

Moreover, the fact that the diversion volume flow 66*a* passes through the opening 64 on the inlet side with a direction of flow 96 which extends transversely to the impeller axis 40 causes a mixing of this diversion volume flow 66*a* with the gas volume flow 58 entering through the inlet channel 22 and so they both enter the impeller channel 24 together, where applicable accelerated by the end section 76 of the inlet channel 22 which narrows with respect to its cross section.

Furthermore, the formation of such a diversion volume flow 66*a* is facilitated even more by the fact that the flow diversion channel 60, at its opening 64 on the inlet side, makes a cross-sectional flow area available which is more than 2.5 times the flow cross section of the opening 62 on the impeller side and by the fact that the flow diversion channel 60 also increases in size constantly from the opening 62 on the impeller side as far as the opening 64 on the inlet side.

As a result, the diversion volume flow 66*a* will be retarded when flowing through the flow diversion channel 60 from the opening 62 on the impeller side as far as the opening 64 on the inlet side and so the flow velocity of the diversion volume flow 66*a* exiting from the opening 64 on the inlet side will correspond approximately to the flow velocity of the gas volume flow entering the inlet channel 22.

Such a design of the flow diversion channel 60 means that, proceeding from the design point illustrated in FIG. 4, it is possible to operate the turbo compressor in partial load operation with a gas volume flow 58 which is significantly below the design point A. For example, the compressor can be operated up to a gas volume flow which is up to 60% below the gas volume flow provided for the design point A without any pumping occurring, i.e. oscillations due to flow instabilities in the gas volume flow.

Moreover, in order to prevent a flow in the flow diversion channel 60 with a component in a circumferential direction 110, the flow diversion channel 60 is subdivided in the circumferential direction 110 by ribs 112 which extend in radial planes 111 in relation to the impeller axis 40 and so the flow diversion channel 60 is formed by a number of channel segments 114 which follow one another in the circumferential direction 110 and are each closed on both sides by the ribs 112, whereby the diversion volume flow 66*a* has, in the region of the opening 64 on the inlet side with a direction of flow 96, essentially no more component in the circumferential direction 110 and, therefore, enters the inlet channel 22 essentially transversely to the impeller axis 40, in particular approximately radially to it.

The turbo compressor according to the invention can, however, as illustrated in FIG. 4, also be operated in the overload range with gas volume flows which are located above the design point A; in these cases, the pressure at the opening 62 on the impeller side will become less with an increasingly larger gas volume flow 58 in relation to the design point A and, therefore, a difference in pressure occurs between the opening 62 on the impeller side and the opening 64 on the inlet side and this leads to the flow diversion channel 60 having a diversion volume flow 66*b* flowing through it which flows from the opening 64 on the inlet side to the opening 62 on the impeller side, i.e. it branches off from the gas volume flow 58 entering the inlet channel 22 in the region of the opening 64 on the inlet side, flows through the flow diversion channel 60 and enters the impeller channel 24 via the opening 62 on the impeller side and there will be compressed even further via the impeller 30.

Such a diversion volume flow 66*b* will not, however, be benefited by the alignment of the opening 64 on the inlet side but rather impeded since such a diversion volume flow 66*b* must leave the inlet channel 22 transversely to the impeller axis 40 in the region of the opening 64 on the inlet side in order to enter the flow diversion channel 60.

This means that during operation of the turbo compressor according to the invention in the so-called overload range, i.e. with gas volume flows 58 which are above the design point, the diversion volume flow 66*b* is not facilitated in the case of the present, constructional design of the turbo compressor according to the invention but rather accepted.

The turbo compressor according to the invention is designed, in particular, at the design point A such that no difference in pressure occurs between the opening 64 on the inlet side and the opening 62 on the impeller side and so also no diversion volume flow 66 will be formed.

The formation of a diversion volume flow 66*a* starts, to begin with, slowly with a reduction in the gas volume flow 58 in relation to the gas volume flow 58 at the design point and increases with increasing reduction in the gas volume flow 58 so that the turbo compressor can still be operated without pumping with a gas volume flow 58 which is at values of 40% of the gas volume flow 58 in the operating point A. In this case, approximately 30% of the incoming gas volume flow 58 will be conveyed back by means of the diversion volume flow from the opening 62 on the impeller side to the opening 64 on the inlet side and supplied to the impeller 30 again.

Figure 10:
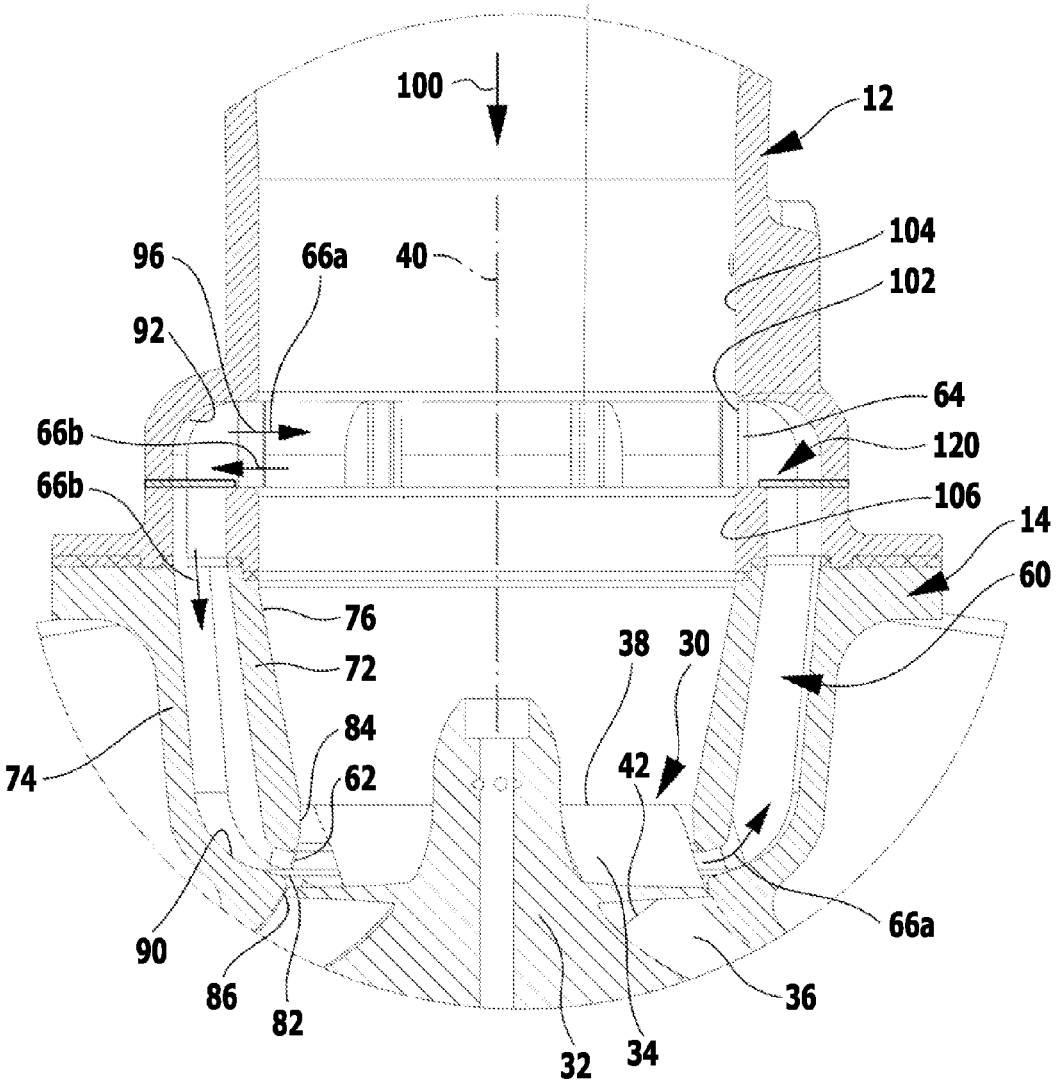
FIG. 10 shows a section similar to FIG. 5 through a second embodiment of a turbo compressor according to the invention.
Figure 11:
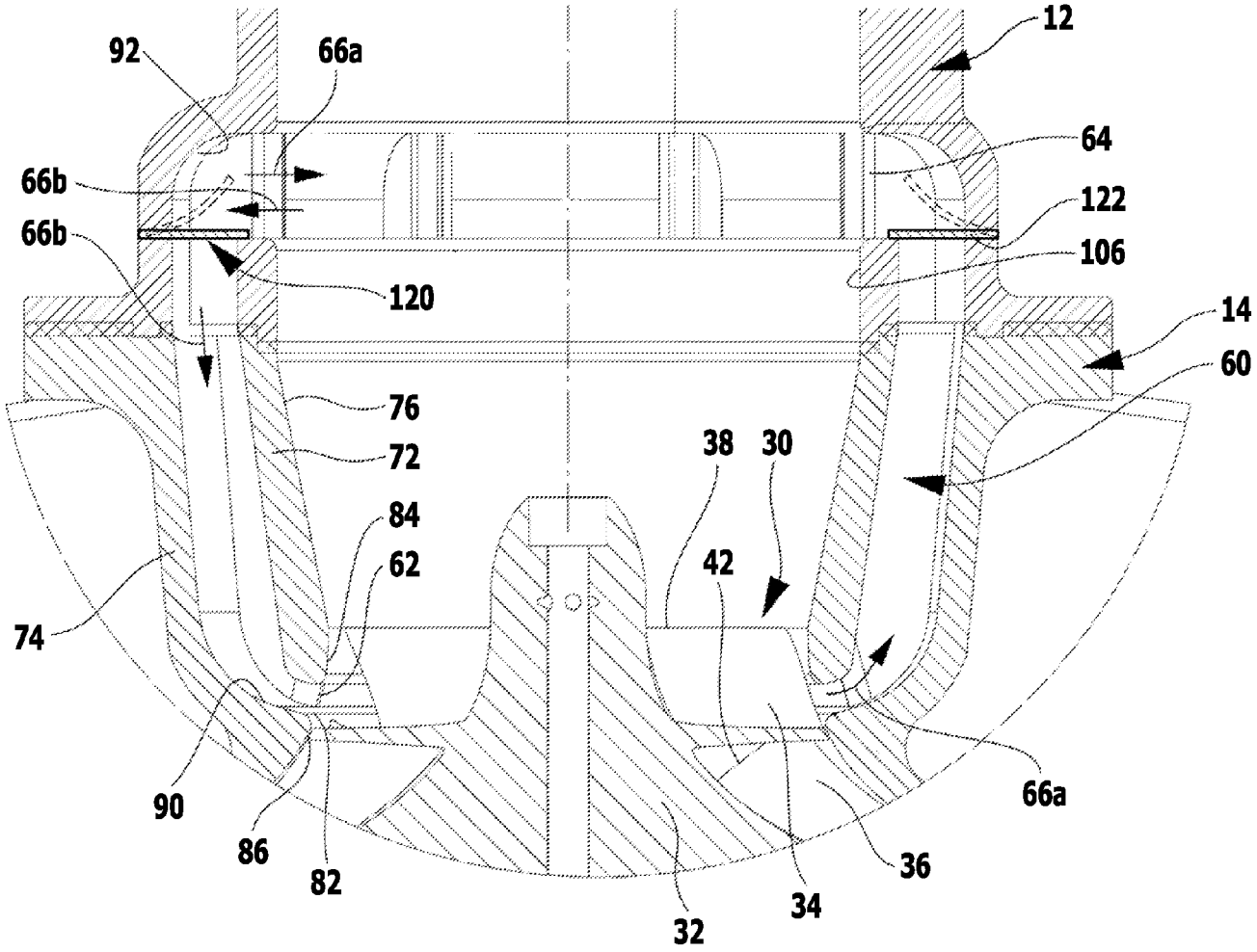
FIG. 11 shows a more enlarged section according to FIG. 10 in the region of the flow diversion channel.

In a second embodiment of a turbo compressor according to the invention, illustrated in FIGS. 10 and 11, a closure unit 120, which is designed as a flutter valve, is associated with the flow diversion channel 60.

The flutter valve 122 comprises a lamella-like element 124 held in the inlet housing 12, wherein the lamella-like element 124 closes the flow diversion channel 60 (illustrated by solid lines) when a diversion volume flow 66*b* would occur on account of the difference in pressure and so a diversion volume flow 66*b* cannot occur.

If, on the other hand, the pressure ratios are such that a diversion volume flow 66*a* occurs, the lamella-like element 124 opens and allows such a diversion volume flow 66*a* (illustrated by dashed lines).

As a result, it is possible with this second embodiment to also design the turbo compressor such that an undesired diversion volume flow 66*b* would occur in the design point A on account of the difference in pressure but will be automatically prevented by the flutter valve 122 and the desired diversion volume flow 66*a* can occur only in the partial load range.

Figure 12:
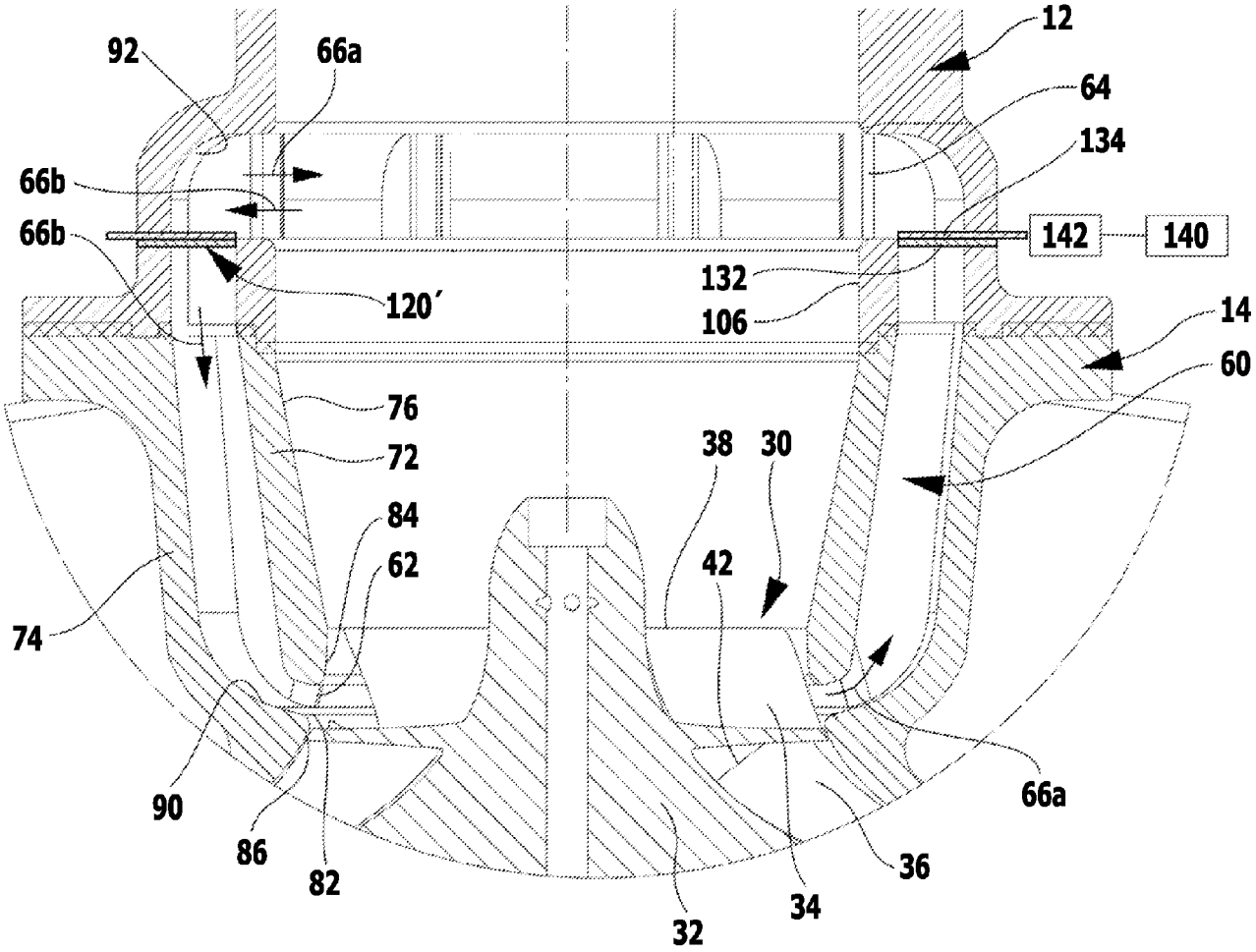
FIG. 12 shows a section similar to FIG. 11 through a third embodiment of a turbo compressor according to the invention.
Figure 13:
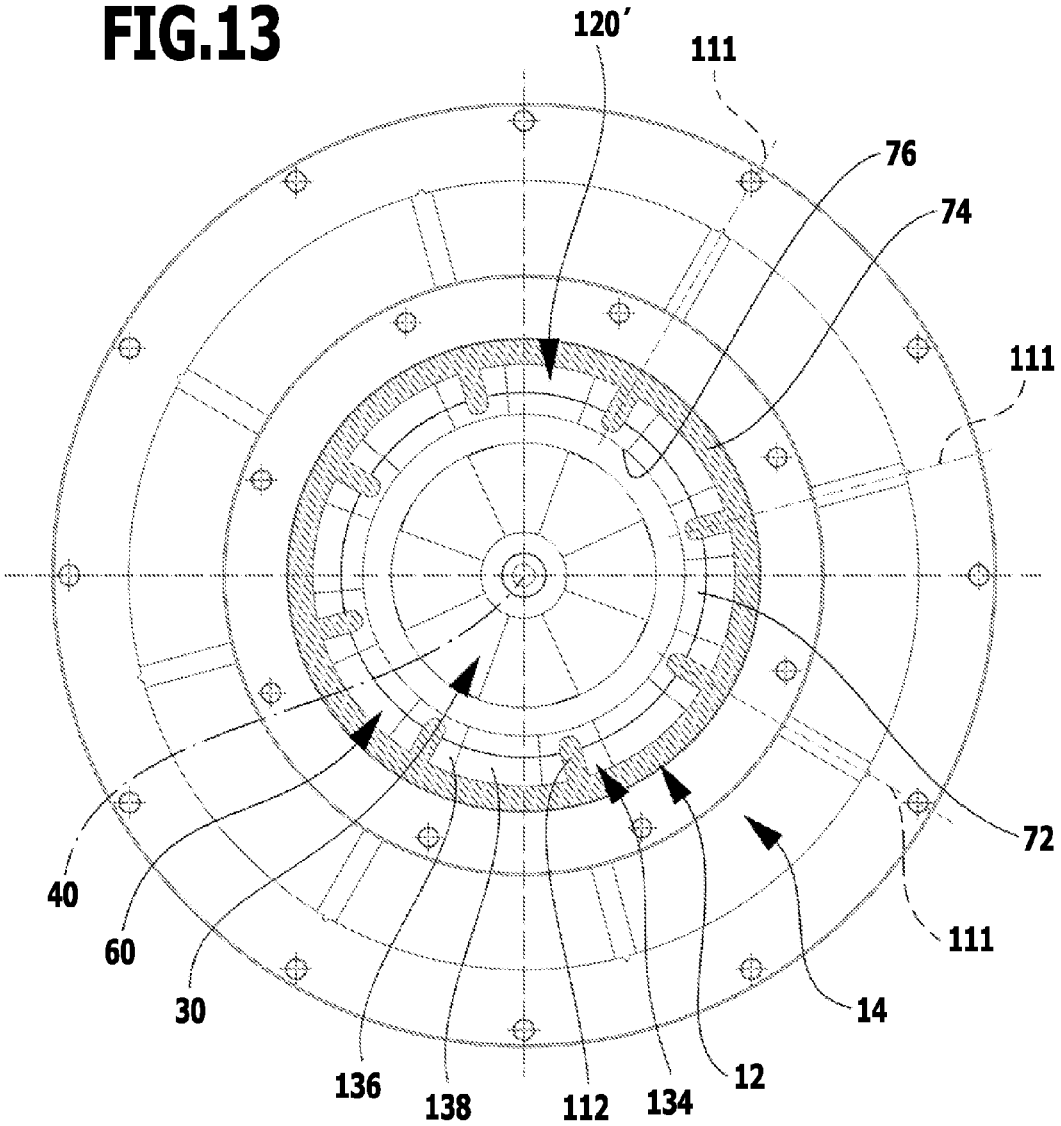
FIG. 13 shows a section similar to FIG. 9 through the third embodiment.

In a third embodiment, illustrated in FIGS. 12 and 13, the closure unit 120' comprises two closure rings 132 and 134 which are arranged one above the other and each of which has a plurality of ring segments, wherein closure segments 136 and opening segments 138 alternate with one another.

The closure rings 132, 134 can be turned relative to one another, for example, by turning the closure ring 134 such that the closure segments 136 of the one closure ring 134 cover the opening segments 138 of the other closure ring 132 or be turned relative to one another such that the closure segments 136 and the opening segments 138 of both closure rings 132, 134 are located on top of one another and so a diversion volume flow 66 can pass through the opening segments located on top of one another.

As a result, it is possible to permit or to prohibit a diversion volume flow 66 in specific operating states.

In particular, a diversion volume flow 66*a* will be permitted during partial load operation and a diversion volume flow 66*b* prohibited during operation close to the design point A or above the design point A.

Preferably, the position of the closure ring 134 relative to the closure ring 132 can be controlled with a control 140 and an adjusting drive 142 such that, for example, a control of the diversion volume flow 66 can also be brought about with respect to its strength in accordance with the pressure and flow ratios as well as flow instabilities as well as, where applicable, the rotational speed of the impeller as a function of the difference in pressure between the opening 64 on the inlet side and the opening 62 on the impeller side detected by the control 140, for example, via sensors.

Figure 14:
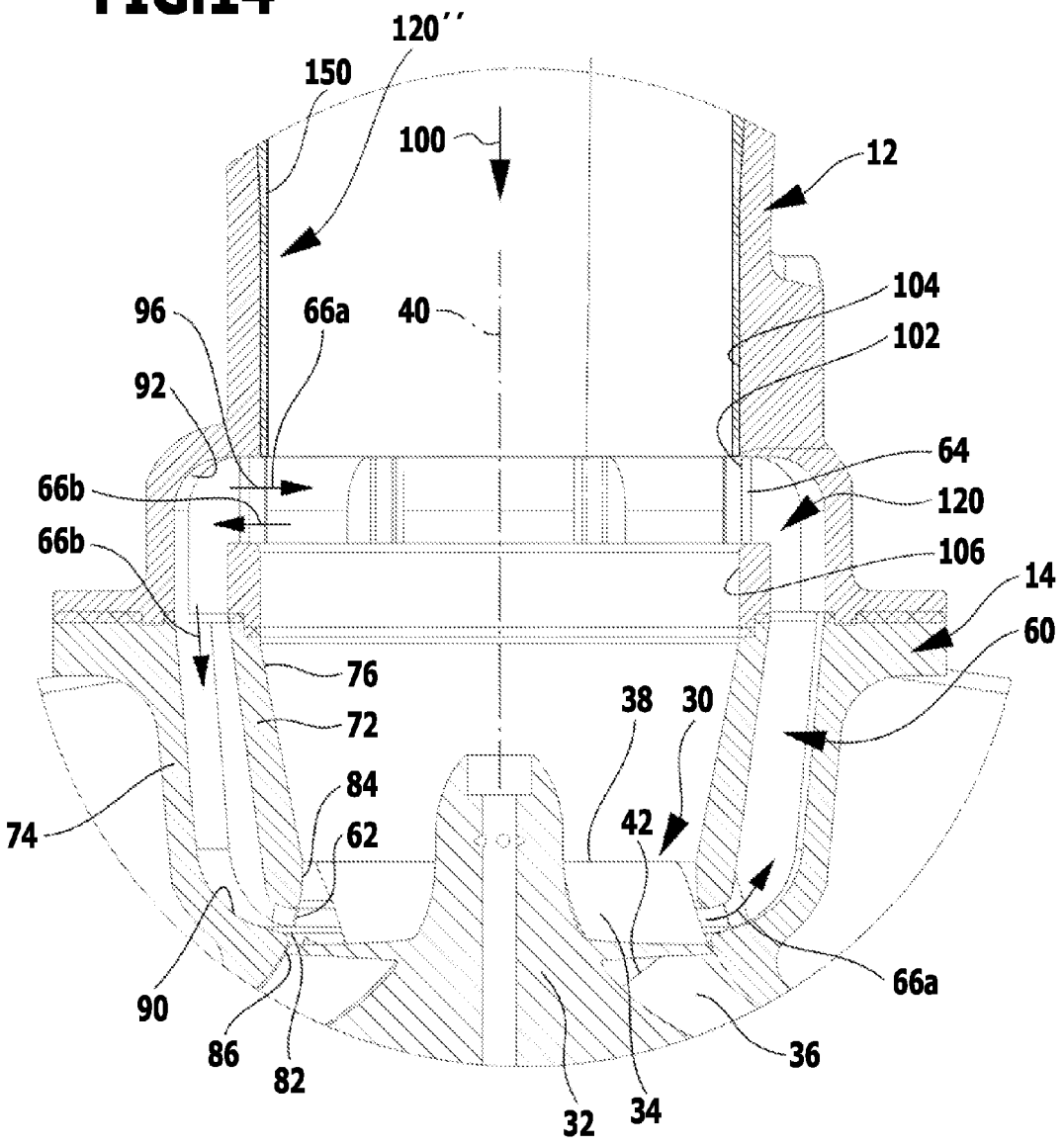
FIG. 14 shows a section similar to FIG. 10 through a fourth embodiment of a turbo compressor according to the invention and FIG. 15 shows a section similar to FIG. 11 through the fourth embodiment.
Figure 15:
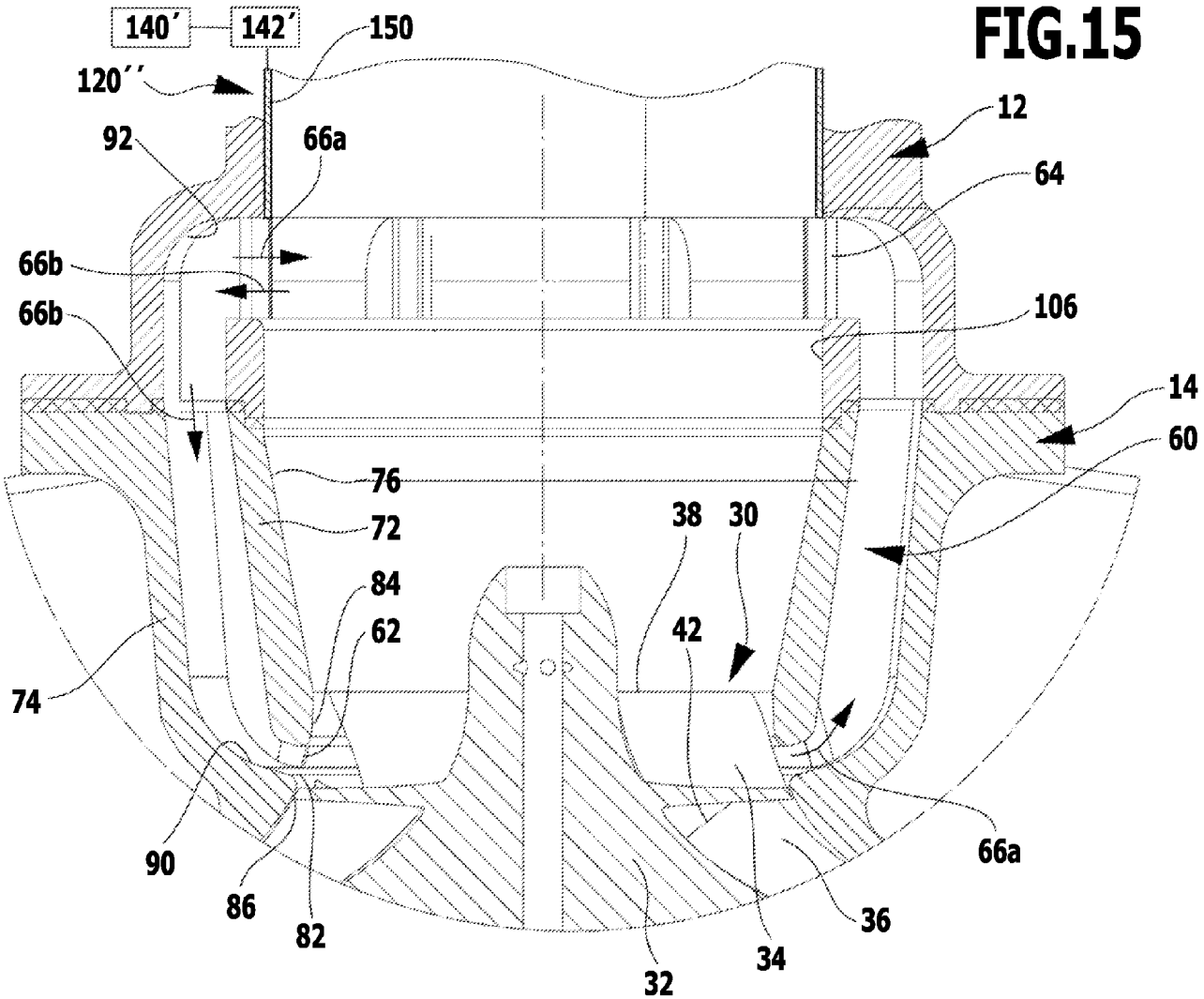

In a fourth embodiment of a turbo compressor according to the invention, illustrated in FIGS. 14 and 15, a slider sleeve 150 is provided in the inlet housing 12, for example guided on the cylindrical surface 104, as closure unit 120" which—as illustrated in FIG. 14—can be moved away from the opening 64 on the inlet side in a direction contrary to the impeller 30 in order to release the opening 64 on the inlet side or can be moved in the direction of the impeller 30 in order to successively close the opening 64 on the inlet side, wherein the position closing the opening 64 on the inlet side is illustrated in FIG. 15.

The slider sleeve 150 can also preferably be controlled by the adjusting drive 142' and the control 140' as a function of pressure and flow ratios in the turbo compressor, as described in conjunction with the third embodiment.

As for the rest, the same reference numerals as in the first embodiment are used for the second, third and fourth embodiments for the same parts and so reference is made in full to the comments on the first embodiment.

The invention claimed is:

1. Turbo compressor comprising a compressor housing, an incoming gas volume flow being supplied in said housing to an impeller channel through an inlet channel, being compressed in the impeller channel by an impeller and being discharged from the impeller channel via an outlet channel, and a flow diversion channel provided in the compressor housing and extending outside of the impeller channel and the inlet channel, said flow diversion channel opening into the inlet channel with an opening on the inlet side and into the impeller channel with an opening on the impeller side and conveying a diversion volume flow between the openings as a function of a difference in pressure, the flow diversion channel having a cross-sectional flow area increasing in size up to the opening on the inlet side proceeding from the opening on the impeller side, the flow diversion channel being adapted to be closed by a closure unit, said closure unit comprising a spring-loaded valve element.

2. Turbo compressor as defined in claim 1, wherein the cross-sectional flow area of the flow diversion channel increases constantly in size with increasing extension thereof from the opening on the impeller side towards the opening on the inlet side.

3. Turbo compressor as defined in claim 1, wherein a cross-sectional flow area of the opening on the inlet side is in the range of between 2.5 times and 3 times the cross-sectional flow area of the opening on the impeller side.

4. Turbo compressor as defined in claim 1 wherein the flow diversion channel is formed by channel segments arranged next to one another in a circumferential direction with respect to an impeller axis, the channel segments being separated from one another in the circumferential direction.

5. Turbo compressor as defined in claim 4, wherein the channel segments are separated from one another by ribs extending in radial planes relative to the impeller axis.

6. Turbo compressor as defined in claim 1, wherein the opening of the flow diversion channel on the impeller side is located in an area of the impeller channel, the impeller having blades moving in said area.

7. Turbo compressor as defined in claim 1 wherein the opening of the flow diversion channel on the impeller side is located in the region between ends of long impeller blades on the inlet side and ends of short impeller blades on the inlet side.

8. Turbo compressor as defined in claim 1, wherein the opening of the flow diversion channel on the impeller side is located in a surface extending constantly in relation to a flow guiding surface located upstream of this opening and a flow guiding surface located downstream of this opening.

9. Turbo compressor as defined in claim 1, wherein the opening of the flow diversion channel on the impeller side is designed to extend around the impeller axis in a circumferential direction.

10. Turbo compressor as defined in claim 1, wherein the opening of the flow diversion channel on the inlet side is located upstream of the impeller.

11. Turbo compressor as defined in claim 10, wherein the opening of the flow diversion channel on the inlet side is arranged at a distance from impeller blades corresponding at least to an extension of the impeller blades in the direction of the impeller axis.

12. Turbo compressor as defined in claim 1, wherein the opening of the flow diversion channel on the inlet side is located in a surface extending essentially parallel to a direction of flow of the gas volume flow in the inlet channel.

13. Turbo compressor as defined in claim 12, wherein the opening of the flow diversion channel on the inlet side is located in a surface extending constantly in relation to flow guiding surfaces in the inlet channel upstream of the opening and flow guiding surfaces downstream of the opening.

14. Turbo compressor as defined in claim 1, wherein the opening of the flow diversion channel on the inlet side is designed to extend circumferentially in relation to an impeller axis.

15. Turbo compressor as defined in claim 1, wherein the flow diversion channel deflects a diversion volume flow coming from the opening on the impeller side in the region of the opening on the inlet side to such an extent that it exits into the inlet channel with a direction of flow transverse to the direction of flow of the incoming gas volume flow.

16. Turbo compressor as defined in claim 1, wherein the flow diversion channel is adapted such that it facilitates a diversion volume flow from the opening on the impeller side to the opening on the inlet side during partial load operation.

17. Turbo compressor as defined in claim 16, wherein the flow diversion channel is designed such that it is in a position during partial load operation to convey more than 20% of the gas volume flow flowing to the impeller.

18. Turbo compressor as defined in claim 1 wherein the flow diversion channel allows a partial load operation of the turbo compressor with gas volume flows between 40% of the gas volume flow provided in the design point and the gas volume flow in the design point.

19. Turbo compressor as defined in claim 1, wherein the closure unit comprises a flutter valve.

20. Turbo compressor as defined in claim 1, wherein the closure unit is configured to interrupt the diversion volume flow from the opening on the inlet side to the opening on the impeller side during an overload state.

21. Turbo compressor as defined in claim 1, wherein the closure unit is configured to suppress the diversion volume flow from the opening on the inlet side to the opening on the impeller side during partial load operation.

* * * * *